United States Patent [19]

Kobale et al.

[11] 4,325,002

[45] Apr. 13, 1982

[54] LUMINESCENT SCREEN FOR FLAT IMAGE DISPLAY DEVICES

[75] Inventors: Manfred Kobale, Faistenhaar; Hans P. Lorenz, Schwarzenbruck; Kaspar Weingand, Gmund; Rolf Wengert, Munich, all of Fed. Rep. of Germany

[73] Assignee: Siemens Aktiengesellschaft, Berlin & Munich, Fed. Rep. of Germany

[21] Appl. No.: 102,541

[22] Filed: Dec. 11, 1979

[30] Foreign Application Priority Data

Dec. 20, 1978 [DE] Fed. Rep. of Germany ..... 2855142

[51] Int. Cl.[3] ..... H01J 61/35; H01J 29/30

[52] U.S. Cl. ..... 313/485; 313/472; 313/493

[58] Field of Search ..... 313/485, 495, 461, 188, 313/472, 484, 220, 493

[56] References Cited

U.S. PATENT DOCUMENTS

| | | | |
|---|---|---|---|
| 2,705,765 | 4/1955 | Geer | 313/472 X |
| 2,882,413 | 4/1959 | Vingerhoets . | |
| 3,582,701 | 6/1971 | Zeliotis | 313/472 |
| 3,614,503 | 10/1971 | Dietch | 313/472 |
| 3,619,698 | 11/1971 | Caras | 313/220 X |
| 3,654,505 | 4/1972 | Davis et al. . | |
| 3,755,027 | 8/1973 | Gilsing | 313/493 X |
| 3,858,083 | 12/1974 | Rehkopf | 313/472 |
| 3,906,285 | 9/1975 | Kobayakawa | 313/496 |
| 3,956,667 | 5/1976 | Veith . | |
| 4,205,255 | 5/1980 | Tomita | 313/472 X |

FOREIGN PATENT DOCUMENTS

| | | |
|---|---|---|
| 684368 | 11/1939 | Fed. Rep. of Germany . |
| 1015312 | 9/1957 | Fed. Rep. of Germany . |
| 2127845 | 1/1972 | Fed. Rep. of Germany . |
| 2412869 | 3/1974 | Fed. Rep. of Germany . |
| 2421442 | 11/1974 | Fed. Rep. of Germany . |
| 2806436 | 2/1978 | Fed. Rep. of Germany . |

*Primary Examiner*—Palmer C. Demeo

*Attorney, Agent, or Firm*—Hill, Van Santen, Steadman, Chiara & Simpson

[57] ABSTRACT

A luminescent screen for flat image display devices, having improved light efficiency comprises a glass screen (1) provided on its inner surface with a pattern of recesses (2) corresponding to a desired luminescent dot pattern with luminescent dot surfaces (5) positioned not only along the bottom of such recesses but also along the upwardly extending recess walls and a contrasting border layer (3) is positioned on the land areas between each recess. In producing such screens, the contrasting border layer is utilized as an etch mask for the recesses and as an application mask for the luminescent material.

8 Claims, 1 Drawing Figure

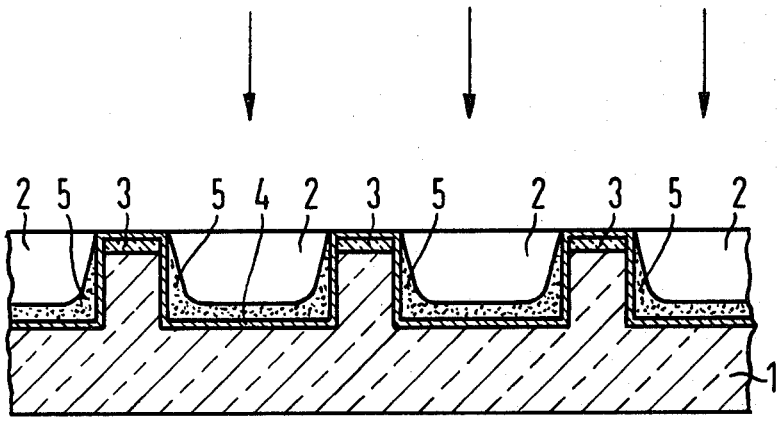
2
5
3
5
4
2
3
5
2
3
5
2
1

LUMINESCENT SCREEN FOR FLAT IMAGE DISPLAY DEVICES

BACKGROUND OF THE INVENTION

1. Field of the Invention

The invention relates to luminescent screens for flat image display devices and somewhat more particularly to such screens wherein the individual luminescent dots are separated from one another by a contrasting border layer.

2. Prior Art

Flat image display devices functioning in accordance with the principles of gas discharge displays, as plasma panels or plasma displays are known, for example see German Offenlegungsschrift No. 24 12 869 (generally corresponding to U.S. Pat. No. 3,956,667). In such flat image display devices, i.e., image display devices using a flat picture screen, a fine-grain luminescent screen with a high light efficiency is required. Plasma in such devices functions as the actual cathode, from which an electron beam is drawn for each luminescent point to be excited via a perforated control panel having a matrix control. In comparison to a classic cathode beam image tube, where a single electron beam must reach all luminescent points, which, with typical large image tube dimensions, requires very high beam acceleration, the electron beams in gas discharge display devices are relatively low energy beams. Further, due to the flat screen structure and the gaseous atmosphere in such devices, high acceleration voltages are not possible. Therefore, it is extremely important for luminescent screens in flat image display devices to obtain a high light efficiency after conversion of electron energy into light or after light generation from the luminescent points or phosphor dots via, for example, impingement on such points or dots by ultraviolet radiation.

For improving light efficiency in classic cathode ray tubes, it is known to coat the luminescent material points or dots on their inner surfaces (i.e., away from the viewing surface), with a mirroring or reflecting metal layer, for example as described in U.S. Pat. No. 3,858,083. In this manner, light emitted by excited luminescent particles toward the back or rear of a so-called luminescent dot is largely reflected by this metal layer and added to the light emitted toward the front. However, the exciting electrodes are also weakened by this metal layer. Such partial electron deenergization is not overly detrimental for high-energy cathode beam electrons but with low-energy electrons used in flat plasma display devices, the use of such metal mirrors is detrimental. Nevertheless, such metal coatings would be desirable for luminescent material layers at the individual luminescent points thereof, not only for it reflective effect but also as a protective means against mechanical loads, particularly given the structure of a flat picture screen where spacer mounts or members are required between the luminescent screen and a perforated control plate. However, in order to minimize the de-energization effect of a metal layer, it would have to be so thin that it could no longer function as a protection means.

It is also known in classic cathode ray tubes to isolate individual luminescent points or dots from each other by opaque borders, for example from the earlier referenced U.S. Pat. No. 3,858,083. In conjunction with flat image display devices, this "black bordering" effect is described and claimed in commonly owned, co-pending U.S. application Ser. No. 012,348 filed Feb. 15, 1979, now U.S. Pat. No. 4,243,735. Such an opaque or black bordering layer about individual luminescent point surfaces is referred to herein and in the claims as "contrasting border layer". Generally, prior art contrasting border layer are comprised of granular glass solder or metal-organo compounds which are subjected to a heating process. When viewed in the light of the required spacer mounts or members for flat image display devices, such contrasting border layers are unsuitable as supports for the spacer mounts because the granular nature thereof cannot sufficiently resist mechanical loads.

SUMMARY OF THE INVENTION

The invention provides a luminescent screen having luminescent points with improved light efficiency even without metallic mirroring layers and capable of stably attaching spacer mounts without endangering a contrasting border layer or the luminescent material layer, and a method of producing such luminescent screen.

In accordance with the principles of the invention, a luminescent screen for flat image display devices is comprised of a glass screen plate positioned on the inside (away from a typical observer) of a luminescent screen and is provided on its inner surface with a plurality of recesses corresponding to a desired pattern of luminescent dots or points, with a luminescent material layer positioned on the bottom of each recess and upward therefrom along the recess walls and a contrasting border layer positioned on the land areas between each recess of the screen plate. In certain embodiments of the invention, a continuously electrically conductive potential layer is positioned beneath the luminescent material layer within each recess and over the contrasting border layer on the land areas between such recesses. In preferred embodiments of the invention, the contrasting border layer is composed of a mixture of a metal and a dielectric, which in certain embodiments has a changing composition throughout the thickness of such a layer so that the uppermost surface thereof is composed substantially of pure metal and in other embodiments has alternating layers of metal and dielectric, with the outermost layer being metal.

By following the principles of the invention, the active luminescent material layer is significantly increased and the resultant screen exhibits improved light efficiency. With the inventive screen structure, the electron beams impinge on more luminescent material particles. The amount of light emitted toward the front becomes significantly greater per luminescent point than when a conventional luminescent material surface is utilized, which only corresponds to a plurality of spaced-apart luminescent points and only lies in the plane of such luminescent points. Primary electrons (i.e., those initially drawn from the plasma) are not the only ones utilized. Secondary electrons, i.e., reflected electrons, for examples from the luminescent layer along the bottom of a recess, also strike the luminescent material particles on the walls of the recess and add to improved light efficiency.

With the inventive structure, the luminescent points are substantially separated from one another. Given a sufficiently deep recess, reflected electrons scattered at one luminescent point cannot reach a neighboring or adjacent luminescent point. Due to this de-coupling of luminescent points, color contrast and purity are significantly improved, relatively to that attained with purely planar screen structures.

With the principles of the invention, a contrasting border layer is formed of a mixture of a metal, such as a Ni, Cu, Pt or Au and a dielectric material, such as $CeO_2$, $Al_2O_3$ or SiO. This border material layer can be applied via vapor deposition and is significantly more stable, relative to a conventional glass solder layer, as a substrate for support mounts of a perforated control plate in an operative flat image display device. Further, such material is substantially harder and adheres better.

In accordance with the principles of the invention, the luminescent screen of the invention is produced by (1) coating the entire area of an inner surface of a glass screen plate with a dark, preferably black, colored contrasting border layer composed of a mixture of a metal and a dielectric material, (2) etching windows in such contrasting border layer in a pattern corresponding to a desired luminescent point pattern, for example corresponding to the conventional three-color grid or pattern for color television, (3) etching recesses into the souncovered glass surface areas situated below the windows in the contrasting border layer; and (4) applying, as by spraying, a layer of luminescent material into such recesses, along the bottom and sides thereof. Thus, with the principles of the invention, the contrasting border layer has multiple functions, both in the ultimate structure and in the production process and significantly reduces the cost of luminescent screens produced in accordance with the principles of the invention.

BRIEF DESCRIPTION OF THE DRAWINGS

The drawing is an enlarged, partial, elevated cross-sectional view of an exemplary embodiment of a luminescent screen constructed in accordance with the principles of the invention.

DESCRIPTION OF THE PREFERRED EMBODIMENTS

The invention provides luminescent screens for flat image display devices having a high light efficiency and improved color purity and a method of producing such screens.

In accordance with the principles of the invention, flat image display screens are comprised of:

(a) a glass screen plate positioned on the inside of a luminescent screen structure having a pattern of recesses therein corresponding to a desired pattern of luminescent points;

(b) a luminescent material layer positioned within each recess along the bottom and upwardly extending walls thereof; and (c) a contrasting border layer positioned on land areas between each recess of the glass screen plate.

In accordance with the principles of the invention, the contrasting border layer is composed of a mixture of a metal and a dielectric material and preferably such layer has a varying composition through its thickness. In one embodiment, such border layer is first comprised of pure dielectric, with gradually increased amounts of metal as such layer extends away from the screen plate so that the outermost portion of such layer is composed of substantially pure metal. In another embodiment, alternating layers of metal and dielectric are utilized, each of varying thickness, with the outermost layer being metallic. This type of contrasting border layer is, particularly when vapor-deposited, significantly more stable, harder and more adherent than glass solder layers heretofore utilized as "black bordering" layers. Further, the contrast bordering layer of the invention is capable of a plurality of functions in a screen structure and in the manufacturing process for such screen structure. For example, in the structure, the contrasting border layer functions to separate the individual luminescent point and to improve the color contrast and purity in addition to functioning as a substrate for support mounts of a perforated control plate of an operative flat image display device. During the manufacturing process, such contrasting border layer functions as an etching mask for producing the desired recesses in the glass screen plate and as an application mask for applying the luminescent materials into such recesses. Further, the contrasting border layer of the invention, is electrically conductive and can function as a potential carrier for the luminescent screen so that a separate anode layer becomes unnecessary.

In achieving a varying contrast bordering layer composition in accordance with the principles of the invention, the amount of metal and dielectric material applied in forming such a layer changes so that at first, relatively pure dielectric material is applied and then gradually more and more metal is added, with decreasing amounts of dielectric material and finally a relatively pure metal final or outermost layer is applied. Alternatively, the contrasting border layer may be composed of alternating layers of dielectric and metal, which are preferably applied in a different layer thickness, with the outermost layer being metallic.

The metallic component of the contrasting border layer of the invention provides the electrical conductivity. Further, due to the fine distribution of these metallic components, whose density increases with increased thickness as seen from the standpoint of an observer in front of the luminescent screen, the contrasting border layer absorbs light very strongly from the observer side, without such metallic particles reflecting light. The final, pure metallic coating or layer of the contrasting border layer renders such border layer opaque and further increases the light absorption so that a very thin layer appear dark or, perferably, black.

The metallic component of the contrasting border layer of the invention is perferably selected from the group consisting of nickel, copper, platinum and gold. The dielectric material component of the contrasting border layer of the invention is preferably selected from the group consisting of cerium oxide ($CeO_2$), aluminum oxide ($Al_2O_3$) and silicon oxide (SiO).

In certain embodiments of the invention a continuous electrically conductive potential layer, functioning as an anode layer in an operative flat image display device, can be applied over the contrasting border layer and beneath the luminescent material layer. The loadability of the contrasting border layer, as for attaching spacer mounts, is not detrimentally affected by such anode layer.

Referring now to the drawing, a glass screen plate 1 is illustrated which, for example, comprises the front pane of gas discharge display in a flat picture screen. In the illustration, the observer side of the screen is toward the bottom of the drawing and the inside of the gas discharge display device is toward the top of the drawing. Spacer mounts attached at the top, perforated control plate supported thereon and the entire back portion of a gas discharge display device, as seen from the observer, are not shown in the drawing. The inner side of the glass screen plate 1 is provided with a plurality of recesses 2, each having an approximately rectangular cross-section. The bottoms of each of these recesses comprise the luminescent point surfaces of the luminescent screen and, accordingly, are applied in the desired luminescent point pattern. A contrasting border layer 3 is positioned on the bridge or land areas between each recess. In the embodiment shown, the bottom and walls of each recesses 2 and the uppermost surface of the contrasting border layer 3 are coated with a continuous electrically conductive layer 4. A luminescent material layer 5 is positioned over the conductive layer 4 within the recesses 2 on the bottoms thereof and extends upwardly along the walls of each recesses. Electrons accelerated in the direction of the luminescent screens are schematically indicated by the arrows.

An exemplary method of manufacturing luminescent screens of the invention is now set forth.

A mixture comprised of a dielectric material, perferably selected from the group consisting of $CeO_2$, $Al_2O_3$ or SiO and a metal, preferably selected from the group consisting of Ni, Cu, Pt and Au is vapor-deposited on the entire surface of a glass screen plate 1 (without recesses 2 therein). During this deposition process, the metal component, for example Ni, is increased from 0 to 100% in the direction away from the screen plate. The vapor-deposition rates can be controlled, for example, by an electron beam with a controlled dwell time oscillating between two crucibles filled with appropriate vaporizable material (i.e., a metal and a dielectric material) or by two controlled electron beams, one over each such crucible or via a temperature-pressure controlled evaporation of the dielectric material in conjunction with a vapor-depositing rate-controlled electron beam for the metal. The deposition is continued until a contrasting border layer 3 having a select thickness, for example 300 nm is produced. This layer appears dark or black to an observer in front of the screen and mirror-like or reflective on the inside of a gas discharge display device.

Next, a photo-sensitive resist is applied onto the so-produced contrasting border layer and exposed and developed in a conventional manner to provided a pattern of windows corresponding to the desired luminescent point pattern, i.e., windows in those areas where recesses 2 are to be formed. Thereafter, the uppermost metal layer (Ni in the embodiment being discussed) of the contrasting border layer is removed through the resist windows with a suitable etchant, for example composed of a mixture of nitric acid and hydrochloric acid or copper sulfate. Next, recesses 2 are etched out with a suitable etchant, for example hydrofluoric acid or a mixture of hydrofluoric acid and sulfuric acid, first through the remaining portions of the contrasting border layer 3 still present under the resist layer and then into the so-uncovered glass surface screen areas. After this etching operation, the resist layer is removed and the resultant glass screen plate having a pattern of recesses 2, with a contrasting border layer 3 on land areas between such recesses is cleansed, for example with an aqueous ultrasonic bath.

As a next step, a continuous electrically conductive layer 4, for example composed of indium oxide ($In_2O_3$) can be sputtered onto all surfaces. Thereafter, the respective bottoms and wall areas of each recess 2 is coated with a luminescent substance layer 5, for example by spraying.

As is apparent from the foregoing specification, the present invention is susceptible of being embodied with various alternations and modifications which may differ particularly from those that have been described in the preceding specification and description. For this reason, it is to be fully understood that all of the foregoing is intended to be merely illustrative and is not to be construed or interpreted as being restrictive or otherwise limiting of the present invention, excepting as it is set forth and defined in the hereto-appended claims.

We claim as our invention:

1. In a luminescent screen for flat image display devices having a glass screen plate with a pattern of luminescent points thereon with the surfaces of such luminescent points being separated from one another by a contrasting border layer, the improvement comprising wherein:

said glass screen plate is provided with a pattern of recesses on an inner surface thereof corresponding to said pattern of luminescent points;

a luminescent material layer is positioned in each of said recesses along the bottom thereof as well as on the upwardly extending walls thereof; and a contrasting border layer is positioned on land areas between each of said recesses, said border layer at a surface layer thereof adjacent said glass surface plate being substantially pure dielectric material and at an outermost surface thereof being substantially pure metal, with a gradually increasing amount of metal between such surfaces.

2. In a luminescent screen as defined in claim 1 wherein a continuous electrically conductive layer is positioned over said contrasting border layer and beneath said luminescent material layer.

3. In a luminescent screen as defined in claim 1 wherein said metal is selected from the group consisting of nickel, copper, platinum and gold and said dielectric material is selected from the group consisting of cerium oxide, aluminum oxide and silicon oxide.

4. In a luminescent screen as defined in claim 3 wherein said metal is nickel.

5. In a luminescent screen for flat image display devices having a glass screen plate with a pattern of luminescent points thereon with the surfaces of such luminescent points being separated from one another by a contrasting border layer, the improvement comprising wherein:

said glass screen plate is provided with a pattern of recesses on an inner surface thereof corresponding to said pattern of luminescent points;

a luminescent material layer is positioned in each of said recesses along the bottom thereof as well as on the upwardly extending walls thereof; and a contrasting border layer is positioned on land areas between each of said recesses and is composed of a plurality of alternating layers, each composed of different mixtures of a metal and dielectric material and each layer being of a different thickness, with the outermost layer being a metal layer.

6. In a luminescent screen as defined in claim 5 wherein a continuous electrically conductive layer is positioned over said contrasting border layer and beneath said luminescent material layer.

7. In a luminescent screen as defined in claim 6 wherein said metal is nickel.

8. In a luminescent screen as defined in claim 5 wherein said metal is selected from the group consisting of nickel, copper, platinum and gold and said dielectric material is selected from a group consisting of cerium oxide, aluminum oxide and silicon oxide.

* * * * *